US005159897A

United States Patent [19]

Franke et al.

[11] Patent Number: 5,159,897

[45] Date of Patent: Nov. 3, 1992

[54] CONTINUOUS-FLOW STEAM GENERATOR

[75] Inventors: Joachim Franke, Altdorf; Volker Kefer; Eberhard Wittchow, both of Erlangen, all of Fed. Rep. of Germany

[73] Assignee: Siemens Aktiengesellschaft, Munich, Fed. Rep. of Germany

[21] Appl. No.: 782,869

[22] Filed: Oct. 15, 1991

Related U.S. Application Data

[63] Continuation of Ser. No. 606,035, Oct. 30, 1990, abandoned.

[30] Foreign Application Priority Data

Oct. 30, 1989 [EP] European Pat. Off. ..... 89120140.2

[51] Int. Cl.[5] ..... F22B 23/06

[52] U.S. Cl. ..... 122/367.3; 122/451 S; 122/6 A

[58] Field of Search ..... 122/1 B, 6 A, 451 S, 122/367.3

[56] References Cited

U.S. PATENT DOCUMENTS

| | | | |
|---|---|---|---|
| 2,167,299 | 7/1939 | Hartmann et al. | 122/1 B |
| 3,205,869 | 9/1945 | Pescatore | 122/451 S |
| 4,248,179 | 2/1981 | Bonner | 122/367.3 |
| 4,262,636 | 4/1981 | Augsburger | 122/1 B |
| 4,290,390 | 9/1981 | Juzi | 122/451 S |
| 4,489,679 | 12/1984 | Holt | 122/451 S |
| 4,552,099 | 11/1985 | Martens et al. | 122/451 S |

*Primary Examiner*—Henry C. Yuen

*Attorney, Agent, or Firm*—Herbert L. Lerner; Laurence A. Greenberg

[57] ABSTRACT

A continuous-flow steam generator includes a vertical gas flue for connection to an outlet conduit of an apparatus emitting hot gas, such as a gas turbine. An evaporator heating surface in the vertical gas flue has an inlet header, an outlet header and tubes connected between the inlet and outlet headers. The tubes form an upper tube segment having an upper segment end and a lower segment end as well as a lower tube segment having an upper segment end and a lower segment end. The upper segment end of the upper tube segment merges with the upper segment end of the lower tube segment.

8 Claims, 3 Drawing Sheets

CONTINUOUS-FLOW STEAM GENERATOR

This application is a continuation of application Ser. No. 606,035, filed Oct. 30, 1990, now abandoned.

The invention relates to a continuous-flow or once-through steam generator including a vertical gas flue for connection to an outlet conduit of an apparatus that outputs hot gas, in particular a gas turbine, and an evaporator heating surface in the vertical gas flue having an inlet header, an outlet header and tubes, the tubes forming an upper tube segment with an upper segment end and a lower segment end, and a lower tube segment with an upper segment end and a lower segment end.

Such a continuous-flow or once-through steam generator is known from German Published, Prosecuted Application DE-AS 1 122 082.

In that known continuous-flow or once-through steam generator, a high-temperature nuclear reactor is connected to the lower end of the gas flue and emits hot gas. Therefore, the hot gas flows through the gas flue from the bottom to the top.

In that device, the inlet header of the evaporator heating surface disposed in the gas flue is located at the upper end of the evaporator heating surface, and the outlet header is located between the upper and the lower ends of the evaporator heating surface. The tubes of the lower end of the upper tube segment of that evaporator heating surface merge with the lower end of the lower tube segment, without intervening headers. Not only evaporation but also preheating of the water and superheating of the steam being generated takes place in the evaporator heating surface. It is only in the upper tube segment, from the inlet header to the outlet header, that there is a flow through the tubes of the evaporator heating surface, in a crosswise countercurrent relative to the vertically upwardly directed hot gas flow. In contrast, a crosswise parallel flow with respect to the hot gas flow takes place through the lower tube segment, in which evaporation primarily occurs. The temperature difference between the water vapor at the upper end of the lower tube segment and the upwardly oriented hot gas flow is only relatively small, so that the expense for heating surfaces is necessarily very high, if adequate presuperheating of the water vapor for the lower tube segment is to be achieved.

If an apparatus that outputs hot gas, for instance a gas turbine, is constructed for approximately mean sea level, then it may certainly be more advantageous with regard to cost to connect the hot gas outlet conduit of that apparatus to the lower end of the vertical gas flue of the continuous-flow or once-through steam generator and not to its upper end, so that the hot gas flows from bottom to top through the vertical gas flue.

It is accordingly an object of the invention to provide a continuous-flow or once-through steam generator, which overcomes the hereinafore-mentioned disadvantages of the heretofore-known devices of this general type and which is optimally constructed for that situation as well.

With the foregoing and other objects in view there is provided, in accordance with the invention, a continuous-flow steam generator, comprising a vertical gas flue for connection to an outlet conduit of an apparatus emitting hot gas, such as a gas turbine, an evaporator heating surface in the vertical gas flue having an inlet header, an outlet header and tubes connected between the inlet and outlet headers, the tubes forming an upper tube segment having an upper segment end and a lower segment end as well as a lower tube segment having an upper segment end and a lower segment end, the upper segment end of the upper tube segment merging with the upper segment end of the lower tube segment.

The evaporator heating surface of a continuous-flow or once-through steam generator of this type, in which not only evaporation but also preheating of the water and superheating of the water vapor being produced can take place, has a flow therethrough in the lower tube segment, with progressive evaporation, in crosswise countercurrent to the hot gas flowing from bottom to top in the gas flue, so that the temperature difference between the hot gas and water/steam in the lower tube segment in the evaporator heating surface is relatively large, and thus the size of the evaporator heating surface can be kept relatively small. However, in the upper tube segment, there is a crosswise parallel flow of water/steam relative to the hot gas in the direction counter to gravity through the evaporator heating surface, thereby largely avoiding the flow disruptions that ensue, particularly at the onset of evaporation, if water is made to flow through a tube in the direction of gravity.

In accordance with another feature of the invention, the tubes of the evaporator heating surface form an additional tube segment above the upper tube segment in the vertical gas flue, the additional tube segment has an upper segment end and a lower segment end, and the lower segment end of the additional tube segment merges with the lower segment end of the upper tube segment.

In accordance with a further feature of the invention, the lower segment end of the upper tube segment is hydraulically connected to the inlet header, and there is provided a water line connected to the inlet header, and an economizer heating surface in the gas flue having an outlet header hydraulically communicating through the water line with the inlet header.

In accordance with an added feature of the invention, there is provided a pressure elevating pump and a control fixture downstream of the pressure elevating pump in the water line.

In accordance with an additional feature of the invention, the outlet header of the economizer heating surface forms a water-steam separator.

In accordance with yet another feature of the invention, the lower segment end of the lower tube segment is hydraulically connected to the outlet header of the evaporator heating surface, and there is provided a first steam line connected to the outlet header of the economizer heating surface, a second steam line connected to the outlet header of the evaporator heating surface and to the first steam line, and a superheater heating surface in the gas flue having an inlet header connected to the second steam line.

In accordance with yet a further feature of the invention, the tubes in at least one of the tube segments have a given point between the upper and lower segment ends, and there is provided a connecting tube connected to the given point, and a pressure equalization vessel outside the vertical gas flue being connected to the connecting tube.

In accordance with a concomitant feature of the invention, the tubes have ribs helically disposed in one of the tube segments.

The book, "Fossil beheizte Dampfkraftwerke" [Fossil-fueled Steam Power Plants], published by Technischer Verlag Resch, Verlag T]V Rheinland, Cologne, Germany, 1986, page 250, does disclose a steam generator with a vertical gas flue, having an outlet conduit of a gas turbine connected to its lower end, so that the flow of hot gas through the gas flue is from bottom to top. However, that is not a continuous-flow or once-through steam generator but instead it is a forced-circulation steam generator with an evaporator heating surface in the gas flue, having an inlet header which is at a lower level than the outlet header. Both the inlet and outlet headers are connected to a drum from which water is pumped into the inlet header of the evaporator heating surface and through the evaporator heating surface entirely in crosswise parallel flow relative to the hot gas from bottom to top.

Other features which are considered as characteristic for the invention are set forth in the appended claims.

Although the invention is illustrated and described herein as embodied in a continuous-flow or once-through steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
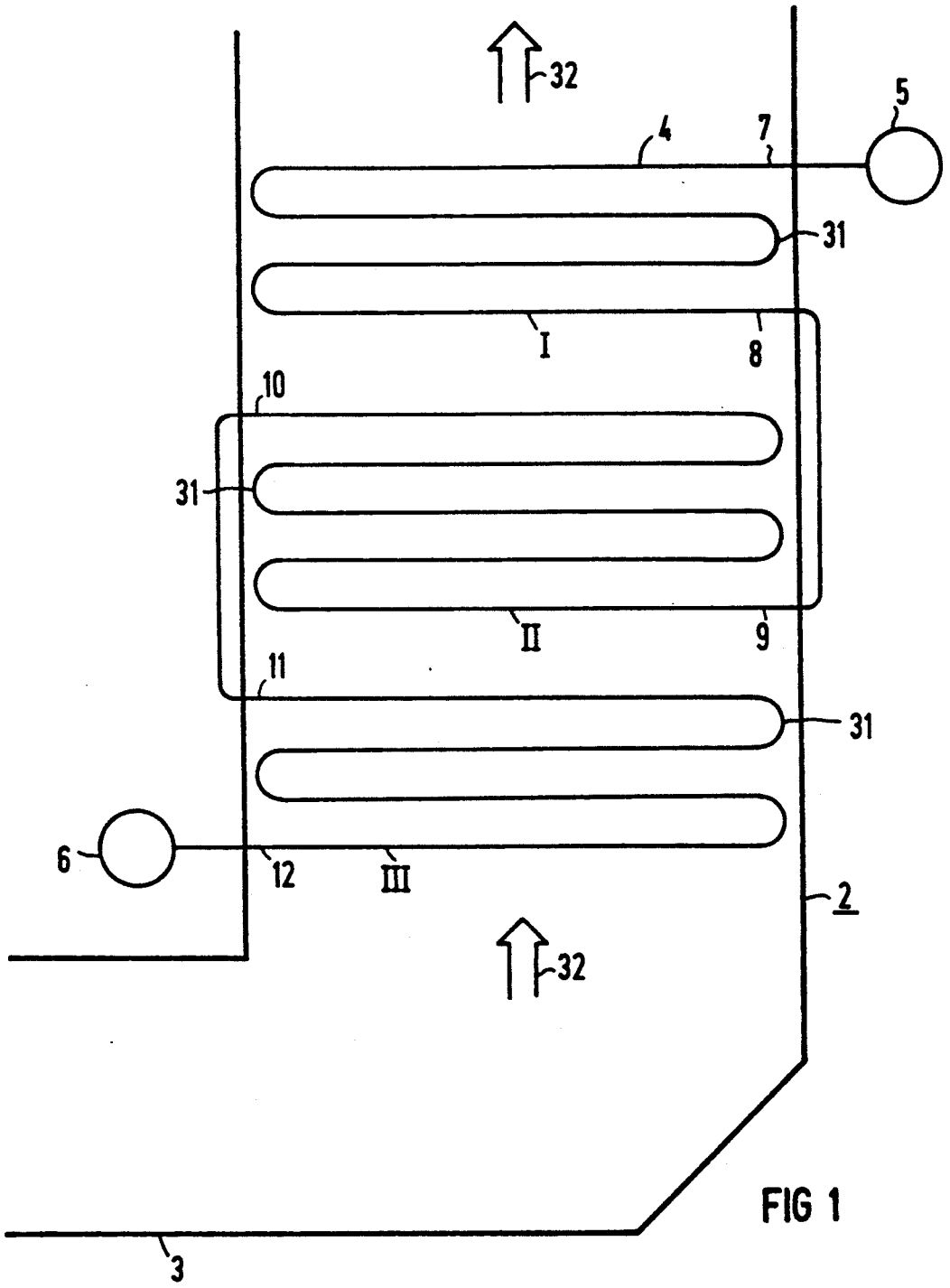
FIG. 1 is a fragmentary, diagrammatic, longitudinal-sectional view of a continuous-flow or once-through steam generator according to the invention.

Referring now to the figures of the drawing in detail and first, particularly, to FIG. 1 thereof, there is seen a continuous-flow or once-through steam generator having a vertical gas flue 2 with rectangular cross section and a gas-tight wall formed of sheet steel. Connected to the lower end of the gas flue 2 is an outlet conduit 3 for hot gas from a gas turbine, so that the hot gas flows through the vertical gas flue 2 from bottom to top in the direction of an arrow 32.

An evaporator heating surface 4 is disposed inside the vertical gas flue 2 and has an inlet header 5 and an outlet header 6 located outside the gas flue 2. The inlet header 5 is located at a higher level than the outlet header 6, or in other words above the outlet header 6.

FIG. 1 shows only a single meandering tube of the evaporator heating surface 4. In actuality, a plurality of such identically constructed tubes is disposed at right angles to the plane of the drawing, in other words crosswise and beside one another in the gas flue 2, and connected to both the inlet header 5 and the outlet header 6. The tubes of the evaporator heating surface 4 can also be extended to the outside through the wall of the gas flue 2 at bends 31 of the tubes, so that the bends 31 are located outside the gas flue 2.

The tubes of the evaporator heating surface 4 form three tube segments I, II and III. An upper tube segment II is located above the lower tube segment III, and an additional tube segment I is located above the upper tube segment II. The additional tube segment I has an upper end 7 hydraulically connected to the inlet header 5. The additional tube segment I also has a lower end 8, which merges with a lower segment end 9 of the upper tube segment II at the outside of the gas flue 2, without intervening headers. On the outside of the gas flue 2, an upper segment end 10 of the upper tube segment II merges with an upper segment end 11 of the tube segment III, without intervening headers. A lower segment end 12 of the lower tube segment III is hydraulically connected to the outlet header 6.

If feedwater from the inlet header 5 flows into the evaporator heating surface 4, then the additional tube segment I has a flow through it in crosswise countercurrent relative to the hot gas flowing in the direction indicated by the arrow 32. In this additional tube segment I, the water is preheated, and evaporation can already begin as well. Although this additional tube segment I has water flowing through it in the direction of the force of gravity, on the other hand the difference between the temperature of the hot gas and the temperature of the water/steam in the additional tube segment I is relatively large, so that the heating surface in the additional tube segment I can be relatively small. Additionally, only relatively little steam is formed in the additional tube segment I, so that virtually no flow disturbances occur.

The upper tube segment II has a flow of evaporating water through it in the direction of the arrow 32 of the hot gas, in other words in a crosswise parallel flow, and thus counter to gravity, so that flow disturbances are avoided in this upper tube segment II.

Finally, the lower tube segment III again has a flow through it in crosswise countercurrent, counter to the direction of the arrow 32 of the hot gas, so that the difference between the temperature of the hot gas and of the water/steam in the lower tube segment III is again relatively large, and the size of the heating surface in the lower tube segment III can again be relatively small. Not only evaporation but also superheating of the steam flowing through it can already occur in the lower tube segment III. In the tube segments I, II, and III, the tubes of the evaporator heating surface 4 may have different inside diameters and thus can carry different flow densities, in order to assure entrainment of vapor bubbles in the crosswise countercurrent with respect to the hot gas on one hand, and to produce only a relatively small pressure loss due to friction in crosswise parallel flow with respect to the hot gas on the other hand.

Figure 2:
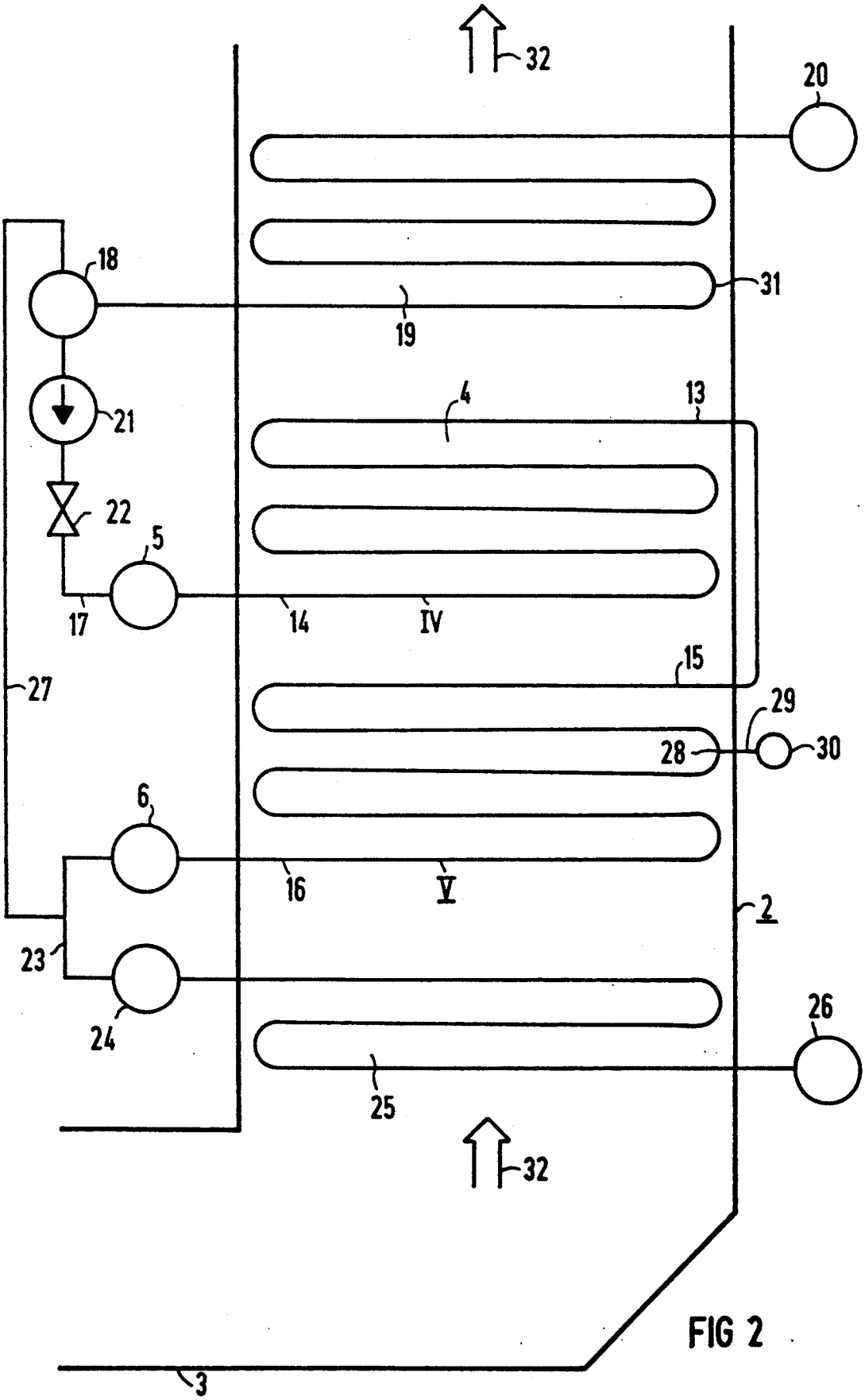
FIG. 2 is a view similar to FIG. 1 of another embodiment of a continuous-flow or once-through steam generator according to the invention.

In FIG. 2, identical elements have the same reference numerals as in FIG. 1. As in FIG. 1, an evaporator heating surface 4 is disposed in the vertical gas flue 2, but its tubes form only two tube segments IV and V. An upper tube segment IV, which is located above a lower tube segment V, has an upper segment end 13 and a lower segment end 14, while the lower tube segment V has an upper segment end 15 and a lower segment end 16. On the outside of the gas flue 2, the upper end 13 of the upper tube segment IV merges with the upper end 15 of the lower tube segment V without intervening headers, and the lower end 16 of the lower tube segment V is hydraulically connected to the outlet header 6 on the outside of the gas flue 2. The lower end 14 of the upper tube segment IV is hydraulically connected to the inlet header 5 of the evaporator heating surface 4, which is likewise located outside the gas flue, where it is disposed at a higher level than the outlet header 6.

The inlet header 5 communicates through a water line 17 with an outlet header 18 of an economizer heating surface 19, which is disposed in the upper end of the gas flue 2 above the evaporator heating surface 4 and which also has an inlet header 20 on the outside of the gas flue 2.

A pressure elevating pump 21 is preferably located in the water line 17 and pumps the water in the direction of the inlet header 5 of the evaporator heating surface 4. The pressure elevating pump 21 is followed by a valve 22 located upstream of the inlet header 5 and serving as a control fixture.

A steam line 23 begins at the outlet header 6 and leads to an inlet header 24 of a superheater heating surface 25 disposed in the lower end of the gas flue 2, below the evaporator heating surface 4. The superheater heating surface 25 has an outlet header 26 on the outside of the gas flue, at a lower level than the outlet header 6. A non-illustrated water-steam separator may advantageously be installed in the steam line 23, for facilitating startup of the continuous-flow or once-through steam generator.

The outlet header 18 of the economizer heating surface 19 preferably forms a water-steam separator, at which a first steam line 27 also begins and leads to the second steam line 23 beginning at the outlet header 6.

In the lower tube segment V of the evaporator heating surface 4, at a point 28 between the upper segment end 15 and the lower segment end 16, a separating connecting tube 29 preferably begins at each tube of the evaporator heating surface 4. The connecting tube 29 is carried to a pressure equalizing vessel 30, which is located outside the vertical gas flue 2.

Figure 3:
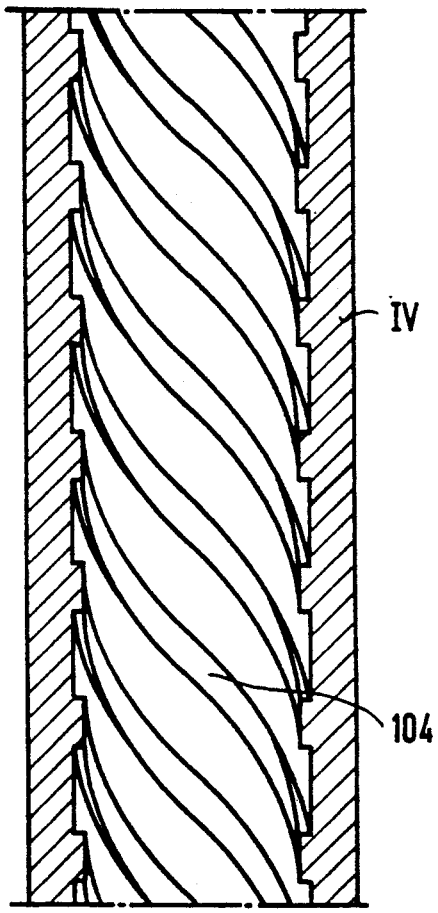
FIG. 3 is a fragmentary, longitudinal-sectional view showing part of a tube of an evaporator heating surface.

As is shown by the longitudinal section of FIG. 3 which is taken through a tube of the evaporator heating surface 4 in the upper tube segment IV, ribs 104 that are helically disposed on the inside of the upper tube segment IV are provided on the tubes of the evaporator heating surface IV, thereby providing improved heat transmission from these tubes to the water evaporating in them.

The evaporation of feedwater flowing out of the inlet header 20 of the continuous-flow or once-through steam generator of FIG. 2 into the economizer heating surface 19 can begin in the tubes of the economizer heating surface 19 as well. Evaporation in the tubes of the economizer heating surface 19 can also be effected at low pressure and therefore at a low evaporation temperature, since the economizer heating surface 19 is hydraulically connected upstream of the pressure elevating pump 21. The difference between the temperature of the hot gas in the gas flue 2 and the evaporation temperature in the tubes of the economizer heating surface 19 is therefore relatively large, so that the economizer heating surface 19 can be made relatively small.

The pressure elevating pump 21 enables compensation or overcompensation to be made for any pressure loss inside the tubes of the evaporator heating surface IV.

Steam already produced in the economizer heating surface 19 can be separated from the water in the outlet header 18 of this economizer heating surface 19 which forms a water-steam separator, and carried through the steam line 27 to the steam line 23 between the outlet header 6 of the evaporator heating surface 4 and the inlet header 24 of the superheater heating surface 25. The pressure elevating pump 21 therefore only needs to pump a relatively small flow of water.

With the aid of the control valve 22, the delivery into the evaporator heating surface 4 can always be regulated in such a way that the steam is already superheated in the evaporator heating surface 4. Moreover, the end of evaporation in the tubes of the evaporator heating surface 4 can be varied with the control valve 22, and as a result a desired steam temperature in the outlet header 26 of the superheater heating surface 25 can always be established in accordance with the load on the continuous-flow or once-through steam generator.

A pressure compensation between the hydraulically parallel-connected tubes of the evaporator heating surface 4 is effected with the aid of the pressure equalization vessel 30. As a result, differences in flow among the various tubes of this evaporator heating surface 4 that arise from the variable heating of the individual tubes of this evaporator heating surface 4 due to local temperature differences in the hot gas, can be reduced.

Finally, superheated steam flows out of the superheater heating surface 25 into the outlet header 26.

A control valve for varying the feedwater delivery can be hydraulically connected upstream of the inlet header 20 of the economizer heating surface 19 of the continuous-flow or once-through steam generator of FIG. 2. A control variable of a control device associated with this control valve can be either the fuel flow into the gas turbine having the outlet conduit 3, the power produced with this gas turbine at an electrical generator, and/or the temperature of the air aspirated by a compressor belonging to the gas turbine.

The larger the quantity of fuel or the output of the electrical generator, or the lower the temperature of the air aspirated by the compressor, the more widely the control valve for varying the delivery of feedwater is opened with the aid of the control device.

In this way, the ratio between the flow of heat given up from the hot gas to the water or steam in the continuous-flow or once-through steam generator, and the supplied flow of feedwater, can always be kept at a predetermined value.

We claim:

1. Continuous-flow steam generator, comprising a vertical gas flue for connection to an outlet conduit of an apparatus emitting hot gas, an evaporator heating surface in said vertical gas flue having an inlet header, an outlet header and first and second heat exchanger sections connected between said inlet and outlet headers, each of said first and second heat exchanger sections having an upper section end and a lower section end, said upper section end of said first heat exchanger section communicating with and being directly connected to said upper section end of said second heat exchanger section, and said lower section ends of said first and second heat exchanger sections respectively communicating with said inlet and outlet headers.

2. Continuous-flow steam generator according to claim 1, including a third heat exchanger section disposed above said first and second heat exchanger sections in said vertical gas flue, said third heat exchanger section having an upper section end communicating with and being directly connected to said lower section end of said first heat exchanger section.

3. Continuous-flow steam generator according to claim 1, wherein said lower section end of said first heat exchanger section is hydraulically connected to said inlet header, and including a water line connected to said inlet header, and an economizer heating surface in said gas flue having an outlet header hydraulically communicating through said water line with said inlet header.

4. Continuous-flow steam generator according to claim 3, including a pressure elevating pump and a control fixture downstream of said pressure elevating pump in said water line.

5. Continuous-flow steam generator according to claim 3, wherein said outlet header of said economizer heating surface forms a water-steam separator.

6. Continuous-flow steam generator according to claim 5, wherein said lower section end of said second heat exchanger section is hydraulically connected to said outlet header of said evaporator heating surface, and including a first steam line connected to said outlet header of said economizer heating surface, a second steam line connected to said outlet header of said evaporator heating surface and to said first steam line, and a superheater heating surface in said gas flue having an inlet header connected to said second steam line.

7. Continuous-flow steam generator according to claim 1, wherein said heat exchanger sections are formed of tubes, said tubes in at least one of said heat exchanger sections having a given point between said upper and lower segment ends, and including a connecting tube connected to said given point, and a pressure equalization vessel outside said vertical gas flue being connected to said connecting tube.

8. Continuous-flow steam generator according to claim 1, wherein said heat exchanger sections are formed of tubes having ribs helically disposed in one of said tube sections.

* * * * *